US010330417B2

(12) United States Patent
Reis Green et al.

(10) Patent No.: US 10,330,417 B2
(45) Date of Patent: Jun. 25, 2019

(54) USER CONFIGURABLE AND MAINTAINABLE FIREARM SUPPRESSOR

(71) Applicants: Austin Reis Green, Dousman, WI (US); Evan Reis Green, Dousman, WI (US)

(72) Inventors: Austin Reis Green, Dousman, WI (US); Evan Reis Green, Dousman, WI (US)

( * ) Notice: Subject to any disclaimer, the term of this patent is extended or adjusted under 35 U.S.C. 154(b) by 263 days.

(21) Appl. No.: 15/343,648

(22) Filed: Nov. 4, 2016

(65) Prior Publication Data

US 2018/0128566 A1 May 10, 2018

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/40
See application file for complete search history.

(56) References Cited

U.S. PATENT DOCUMENTS 5,685,102 A * 11/1997 Latka ..... F41A 21/325 42/76.01
8,387,299 B1 * 3/2013 Brittingham ..... F41A 21/30 42/90
8,516,941 B1 * 8/2013 Oliver ..... F41A 21/30 181/223
8,910,746 B1 * 12/2014 McKenzie ..... F41A 21/30 181/223
8,991,551 B2 * 3/2015 Latka ..... F41A 21/30 181/223
8,997,621 B1 * 4/2015 Dater ..... F41A 21/325 89/14.3
9,080,829 B1 * 7/2015 Cellini ..... F41A 21/36
9,239,201 B1 1/2016 Reis Green
9,500,427 B1 * 11/2016 Larue ..... F41A 21/30
9,513,078 B1 * 12/2016 Fulton ..... F41A 21/30
9,631,888 B2 * 4/2017 Young ..... F41A 21/325
9,746,267 B2 * 8/2017 Smith ..... F41A 21/30
9,816,773 B1 * 11/2017 Reis Green ..... F41A 21/30
9,857,137 B2 * 1/2018 Barrett ..... F41A 21/30
(Continued)

FOREIGN PATENT DOCUMENTS

CH 702214 A2 * 5/2011 ..... F41A 21/30

*Primary Examiner* — Benjamin P Lee
(74) *Attorney, Agent, or Firm* — Dunlap Bennett & Ludwig PLLC

(57) ABSTRACT

A user configurable and maintainable firearm sound suppressor is provided. The sound suppressor is a magnum powered rifle suppressor that can be configured to provide suitable use on a high-powered rifle or a pistol. A mount interface of the suppressor can be replaced and a dual taper baffle can be removed and replaced with a pistol recoil booster system which allows optimal use for both rifles and pistols. The dual taper baffle and rifle or magnum mounting interface adds safety factor such that system durability and safety are not compromised. The user configurable and maintainable firearm suppressor allows the end user to have ideal firearm handling characteristics for a wide variety of firearms, reducing the need to purchase numerous sound suppressors for a collection of firearms. A novel two-part end cap allows disassembly of the suppressor and prevents inadvertent loosening of component parts during use.

14 Claims, 5 Drawing Sheets

(56) References Cited

U.S. PATENT DOCUMENTS

| | | | | |
|---|---|---|---|---|
| 10,054,382 | B2 * | 8/2018 | Palu | F41A 21/30 |
| 2011/0036233 | A1 * | 2/2011 | DeGroat | F41A 21/325<br>89/14.4 |
| 2012/0103176 | A1 * | 5/2012 | Latka | F41A 21/30<br>89/14.4 |
| 2012/0152649 | A1 * | 6/2012 | Larue | F41A 21/36<br>181/223 |
| 2013/0180150 | A1 * | 7/2013 | Dueck | F41A 21/325<br>42/90 |
| 2014/0020977 | A1 * | 1/2014 | Shults | F41A 21/30<br>181/223 |
| 2014/0224575 | A1 * | 8/2014 | Latka | F41A 21/30<br>181/223 |
| 2014/0231168 | A1 * | 8/2014 | Dueck | F41A 21/325<br>181/223 |
| 2015/0260472 | A1 * | 9/2015 | Smith | F41A 21/30<br>89/14.2 |
| 2016/0018179 | A1 * | 1/2016 | Morris | F41A 21/30<br>181/223 |
| 2016/0209151 | A1 * | 7/2016 | Smith | F41A 21/30 |
| 2018/0106569 | A1 * | 4/2018 | Smith | F41A 21/30 |

* cited by examiner

USER CONFIGURABLE AND MAINTAINABLE FIREARM SUPPRESSOR

BACKGROUND OF THE INVENTION

The present invention relates to firearm suppressors and, more particularly, to a user configurable firearm suppressor that may be quickly and easily disassembled for cleaning and maintenance.

Despite the popularity of current firearm suppressors, a number of problems remain. The cost of each firearm suppressor is relatively high. Currently, each type of firearm uses a different type of suppressor. For example, a 6" overall length 14.5 ounce welded suppressor is intended to be used with 5.56 mm ammunition only. A 6.7" pistol silencer may be intended to be used with 9 mm pistol ammunition. This design intent is sometimes unknown to the user, and the user may fire a 5.56 mm rifle round through a 9 mm pistol suppressor which destroys the suppressor and launches the suppressor down range. For a user that has many types of firearms, purchasing the corresponding suppressor for each firearm can be very costly.

Additionally, cleaning or servicing the internals of firearm suppressors can be very difficult or impossible. Current suppressors may have end caps that unscrew to access the internal components. However, the threaded end caps loosen in as few as five to ten shots due to vibration. Welded end caps prevent access to the internal components. Threaded mono baffle designs become lead and copper brazed to the tube which also prevents access.

As can be seen, there is a need for a user configurable firearm suppressor that can be quickly and easily disassembled for cleaning and maintenance.

SUMMARY OF THE INVENTION

In one aspect of the present invention, a firearm suppressor comprises: a cylindrical body having a first end, a second end, wherein the second end comprises a discharge bore, and an inner surface forming an internal bore, wherein the internal bore comprises a proximal portion and a distal portion, wherein the inner surface of the proximal portion comprises a taper forming a female frusto-conical surface; a plurality of baffles disposed within the distal portion of the cylindrical body; and a firearm mount interface comprising a receiving bore releasably securable to a firearm, wherein the firearm mount interface is releasably secured to the first end of the cylindrical body.

In another aspect of the present invention, a firearm suppressor comprises: a cylindrical body having a first end, a second end, wherein the second end comprises a discharge bore, and an inner surface forming an internal bore, wherein the internal bore comprises a proximal portion and a distal portion, wherein the inner surface of the proximal portion comprises a taper forming a female frusto-conical surface; a firearm mount interface comprising a receiving bore releasably securable to a firearm, wherein the firearm mount interface is releasably secured to the first end of the cylindrical body; and a rifle baffle disposed within the proximal portion of the internal bore and comprising a distal end comprising an outer surface comprising a taper forming a male frusto-conical surface nesting against the female frusto-conical surface.

These and other features, aspects and advantages of the present invention will become better understood with reference to the following drawings, description and claims.

DETAILED DESCRIPTION OF THE INVENTION

Figure 2:
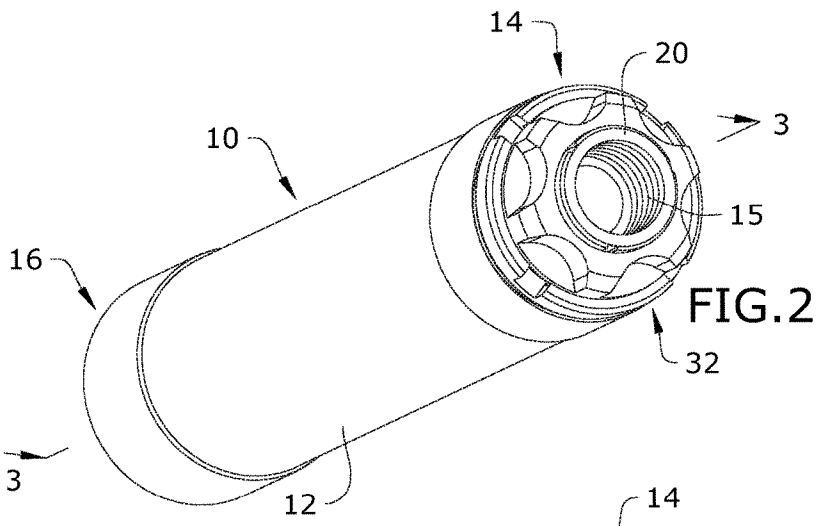
FIG. 2 is a rear perspective view of an embodiment of the present invention.
Figure 1:
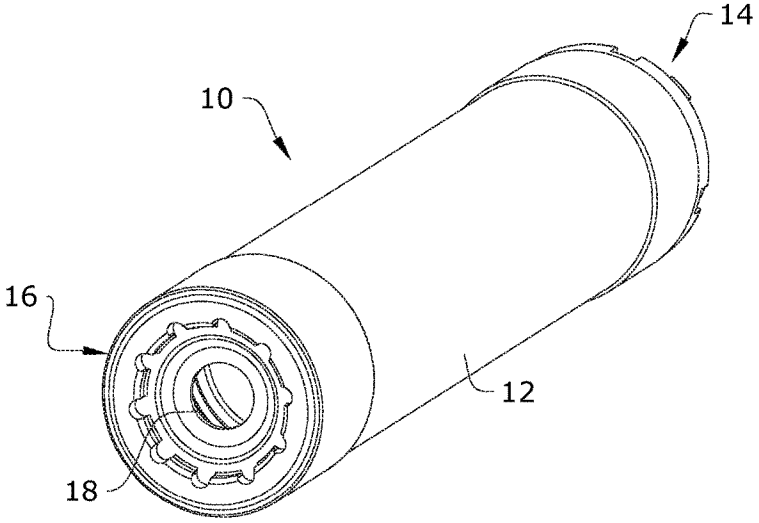
FIG. 1 is a front perspective view of an embodiment of the present invention.
Figure 3:
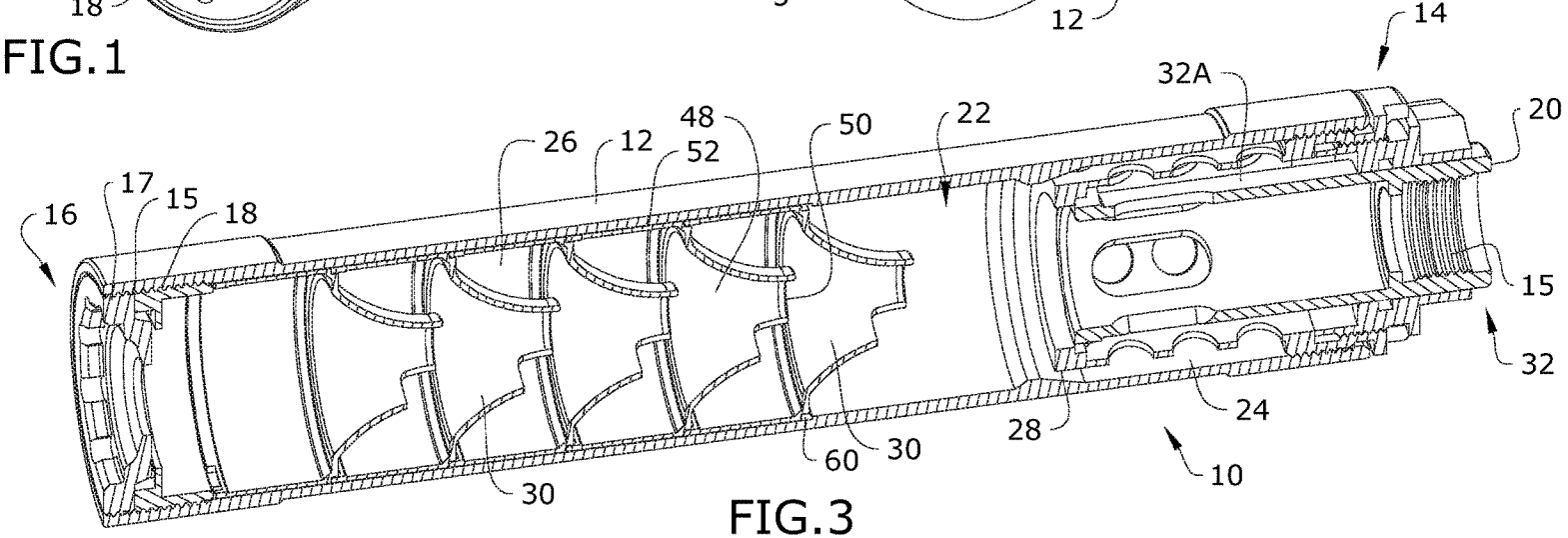
FIG. 3 is a section detail view along line 3-3 of FIG. 2.
Figure 4:
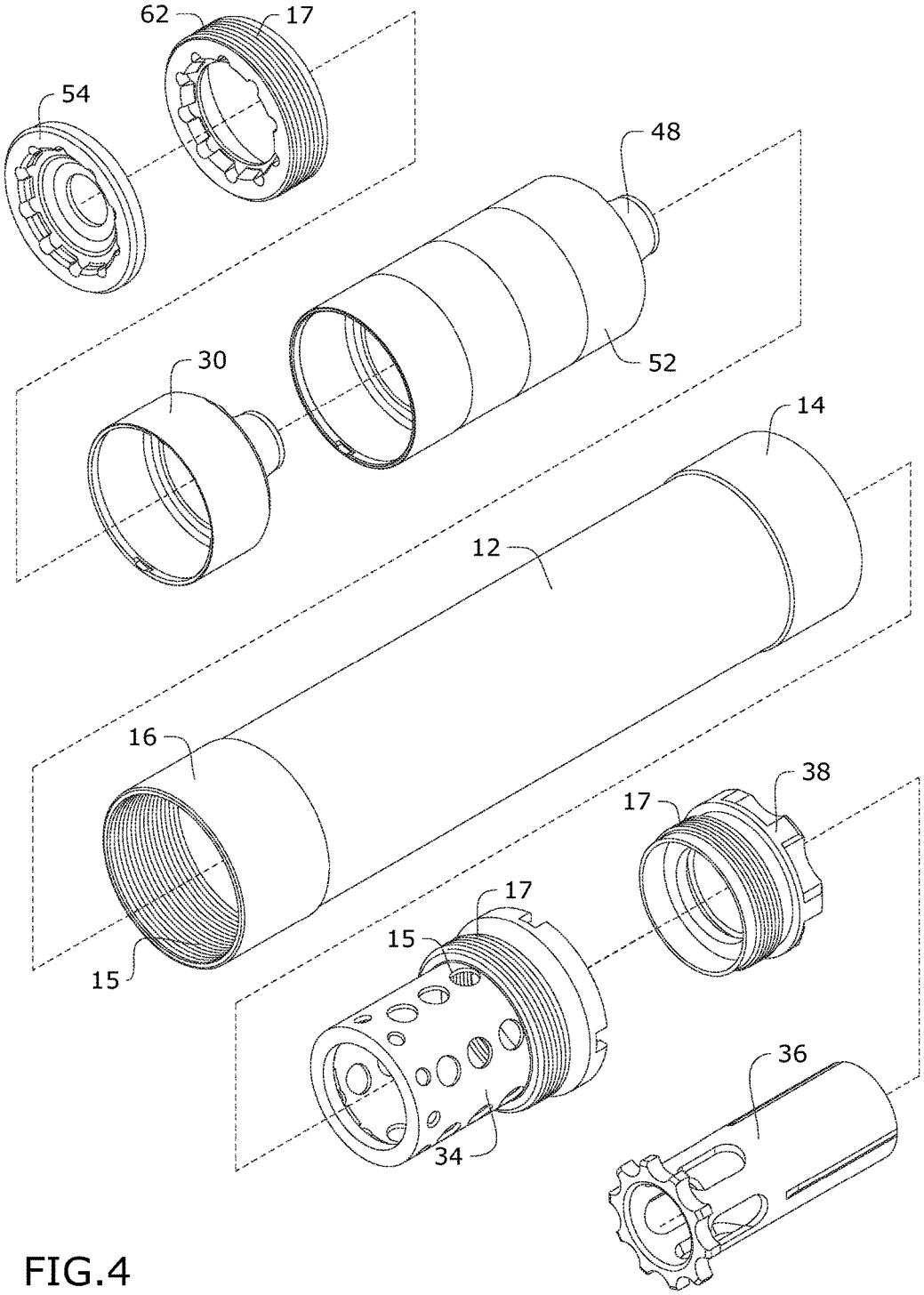
FIG. 4 is an exploded view of an embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

A user configurable and maintainable firearm sound suppressor is provided. The suppressor includes a cylindrical body having first end and a second end opposite the first end. The cylindrical body includes an internal bore, the first end includes a receiving bore and the second end includes a discharge bore aligning with one another. The internal bore includes a proximal portion and a distal portion. The distal portion contains a plurality of baffles, and in some configurations, the proximal portion contains a single baffle with two tapered engagement surfaces. Where the single baffle is present, the distal end taper of the baffle engages the cylindrical body's taper, and the proximal taper of the baffle engages a tapered surface of a firearm mount interface. The proximal portion includes an open bore suitable for receiving one of a plurality of firearm mount interfaces. The interfaces configure the firearm suppressor in pistol, high power, and magnum powered rifle embodiments. The firearm suppressor allows the user to change configurations to vary length, sound performance, enhance usability, reliability, and safety factors beyond the capabilities of prior art systems to suit the desired host firearm parameters. The present invention may be adaptable to a user's entire firearms collection. The user configurable and maintainable firearm sound suppressor also includes a novel distal end cap design allowing desirable ease of disassembly for cleaning and maintenance.

As mentioned above, the suppresser of the present invention may be utilized with different types of firearms. The suppressor of the present invention confronts several major engineering obstacles. In the pistol configuration, the suppressor is light enough for reliable cycling on semi-automatic tilt-unlocking pistols, and its size is compact for ideal pistol handling. For the rifle configuration, the suppressor is strong, safe, durable and also larger in size to provide optimal sound performance. In order to be maintainable and serviceable, the present invention provides access to internal components, yet does not come apart during use.

The cylindrical body includes a double bored tube made of a material with a high strength to weight ratio such as aluminum, titanium, stainless steel and the like. In certain embodiments, the present invention may be made of 17-4PH, which is stainless steel that provides a substantial increase in strength without excessive weight and is relatively low in cost. The double bored tube of the present invention allows the primary baffle used for rifle configurations to be housed in its own bore, taking linear force application away from the pistol baffles in front of it, reducing their yield stress in the assembly. The mounting systems for the rifle configurations add volume, allowing pressure to be halved. In combination with the primary baffle, the rifle configurations increase dwell and further reduce peak pressure reaching the pistol baffles by approximately 75% in total, allowing the pistol baffles to be light enough for pistol use, yet strong enough for use in high power and magnum calibers.

Referring to FIGS. 1 through 8, the present invention includes a firearm suppressor 10. The firearm suppressor 10 includes a cylindrical body 12 having a first end 14 opposite a second end 16. The second end 16 includes a discharge bore 18. A firearm mount interface 32 is releasably secured to the first end 14. In certain embodiments, the first end of the cylindrical body 12 may include female threads 15 that mechanically fasten to male threads 17 of the firearm mount interface 32. The firearm mount interface 32 includes a receiving bore 20 that releasably secures to an end of a barrel of a firearm. An internal bore 22 is formed by an inner surface of the cylindrical body 12. The internal bore 22 includes a proximal portion 24 and a distal portion 26. The inner surface of the proximal portion 24 includes a taper forming a female frusto conical surface 28. A plurality of baffles 30 are disposed within the distal portion 26 of the cylindrical body 12.

Each of the baffles 30 of the present invention may include a frusto-conical sidewall 48. The frusto-conical sidewall 48 includes an apex having an axial bore 50 and a base 52 opposite the apex. The apex is disposed towards the receiving bore 20 and the base 52 is disposed toward the discharge bore 18.

In certain embodiments, the baffles 30 may be removable from the cylindrical body 12. A ledge 60 is formed on the inner surface of the distal portion 26. The base of the rearward most baffle 30 abuts against the ledge 60. The second end of the cylindrical body 12 may also include female threads 15. A discharge end cap 54 and a lock collar 62 may each include male threads 17 that mechanically fasten to the female threads 15 of the second end 16. The discharge end cap 54 and the lock collar 62 may include the discharge bore 18. The inner surface of the discharge end cap 54 includes a taper forming a male frusto-conical surface. The outer surface of the lock collar 62 includes a taper forming a female frusto-conical surface. The baffles 30 are stacked within the distal portion 26, the lock collar 62 is abutting the forward most baffle 30 and the discharge end cap 54 is tightened against the lock collar 62 so that the male frusto-conical surface is within and abuts against the female frusto-conical surface. The tapered fit removes tolerance, dampens vibration, and locks the discharge end cap 54 in place, preventing the undesired loosening of the discharge end cap 54. To remove the baffles 30 for cleaning, the discharge end cap 54 and the lock collar 62 are unscrewed from the second end 16. The baffles 30 may then slide out of the cylindrical body 12.

The cylindrical body 12 of the present invention allows users to interchange between different types of firearm mount interfaces 32. Therefore, the firearm suppressor 10 of the present invention may be used with different types of firearms. A pistol mount interface 32A may be secured to the cylindrical body 12, allowing the firearm suppressor 10 to be used with a pistol. A rifle mount interface 32B may be secured to the cylindrical body 12, allowing the firearm suppressor 10 to be used with a rifle. A magnum rifle mount interface 32C may secured to the cylindrical body 12, allowing the firearm suppressor 10 to be used with a high powered rifle.

As illustrated in FIGS. 1 through 5, the firearm mount interface 32 may be the pistol mount interface 32A. The pistol mount interface 32A may include a housing 34, a piston 36 and an end cap 38. The housing 34 may include a plurality of vents, external male threads 17 and internal female threads 15. The piston 36 may include radially disposed spokes, vents and the receiving bore 20 that releasably secures to a pistol. The end cap 38 may include male threads 17. The piston 36 fits within the housing 34. The male threads 17 of the end cap 38 mechanically fasten to the female threads 15 of the housing 34, securing the piston 36 within the housing 34. The male threads 17 of the housing 34 mechanically secure to the female threads 15 of the first end of the cylindrical body 12, attaching the pistol mount interface 32A to the cylindrical body 12.

Figure 5:
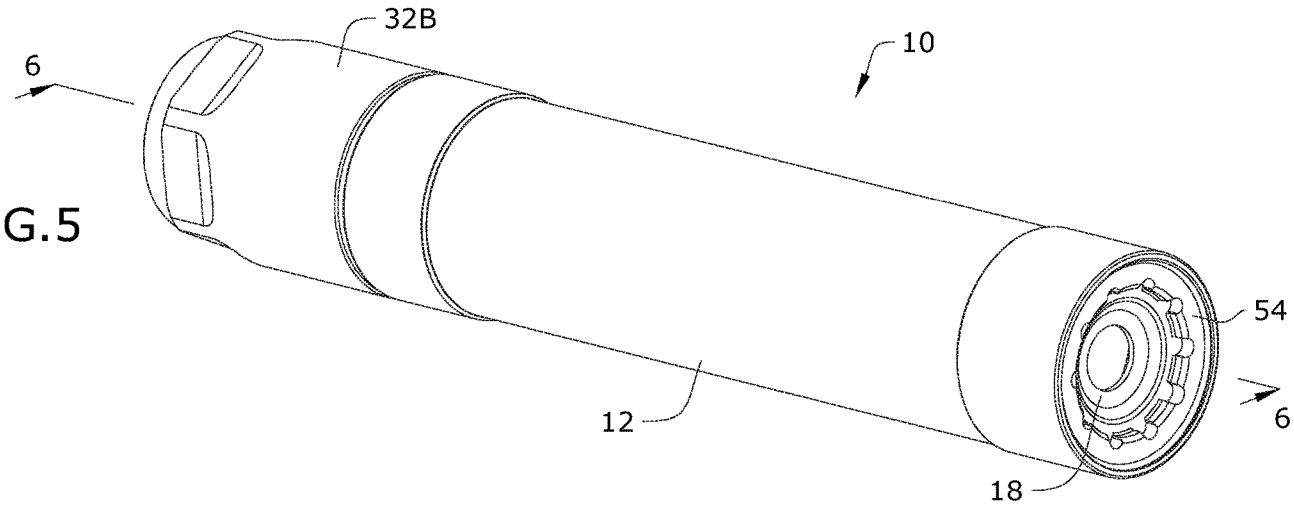
FIG. 5 is a perspective view of an embodiment of the present invention.
Figure 6:
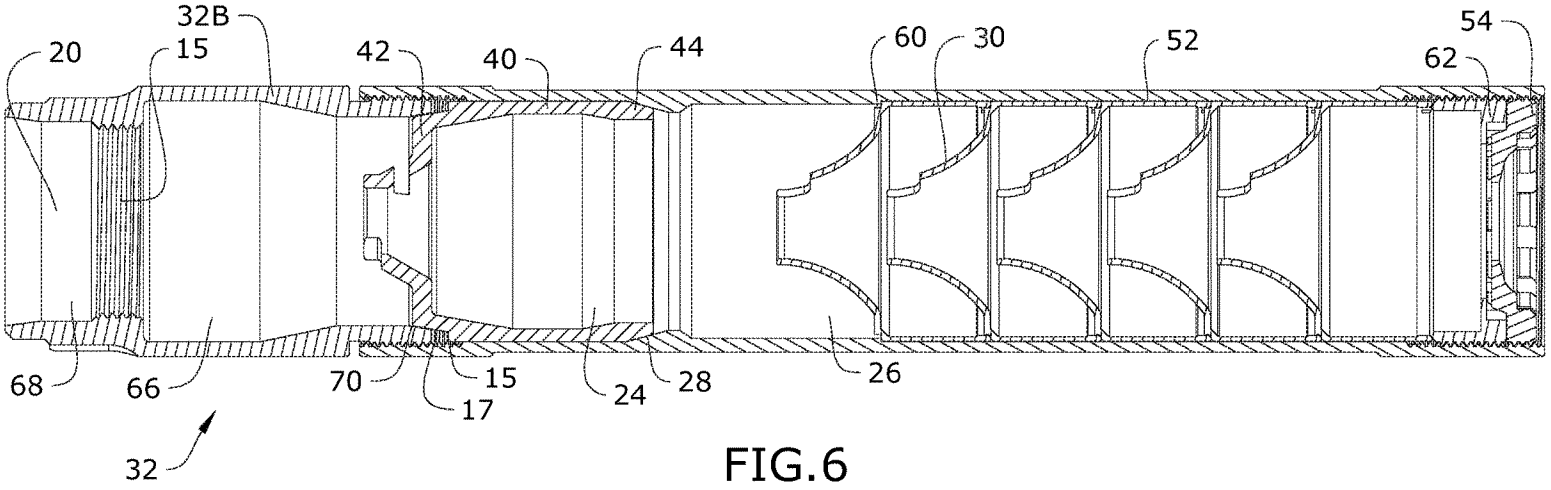
FIG. 6 is a section detail view along line 6-6 of FIG. 5.
Figure 7:
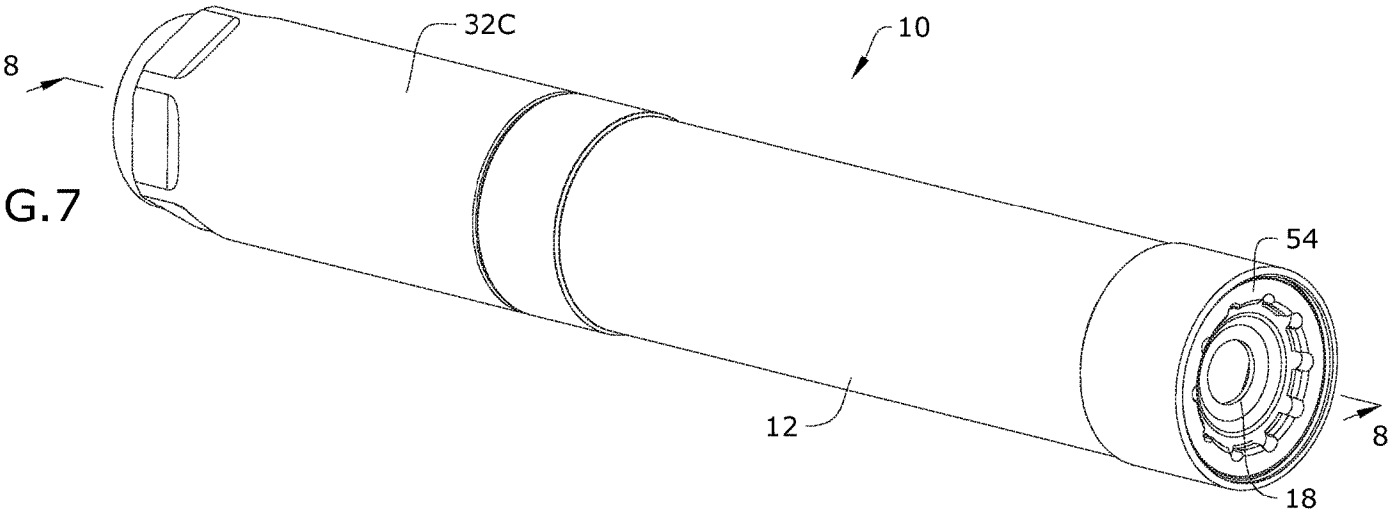
FIG. 7 is a perspective view of an embodiment of the present invention.
Figure 8:
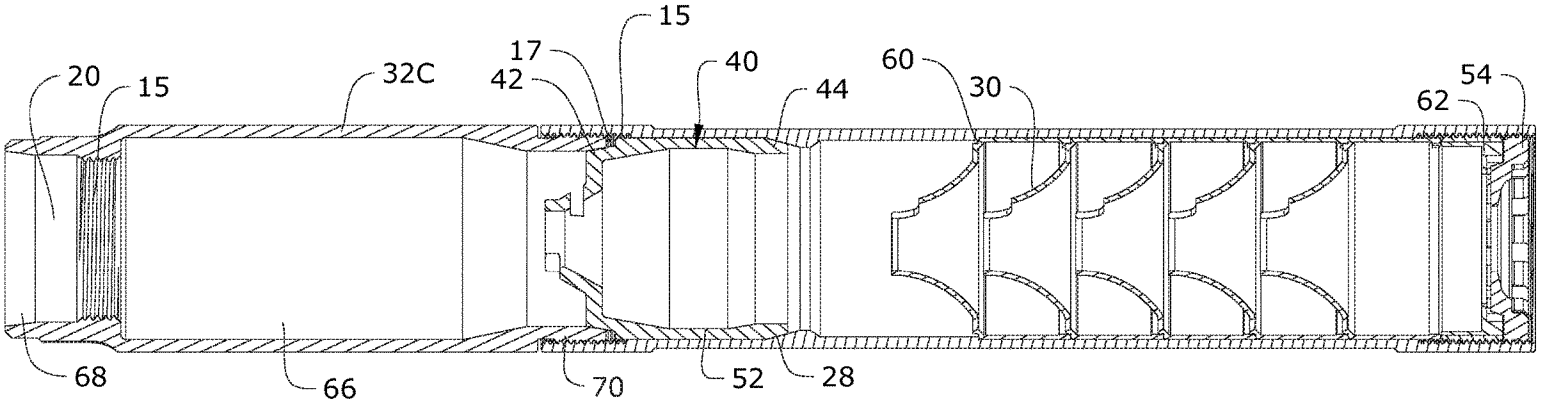
FIG. 8 is a section detail view along line 8-8 of FIG. 7.
Figure 9:
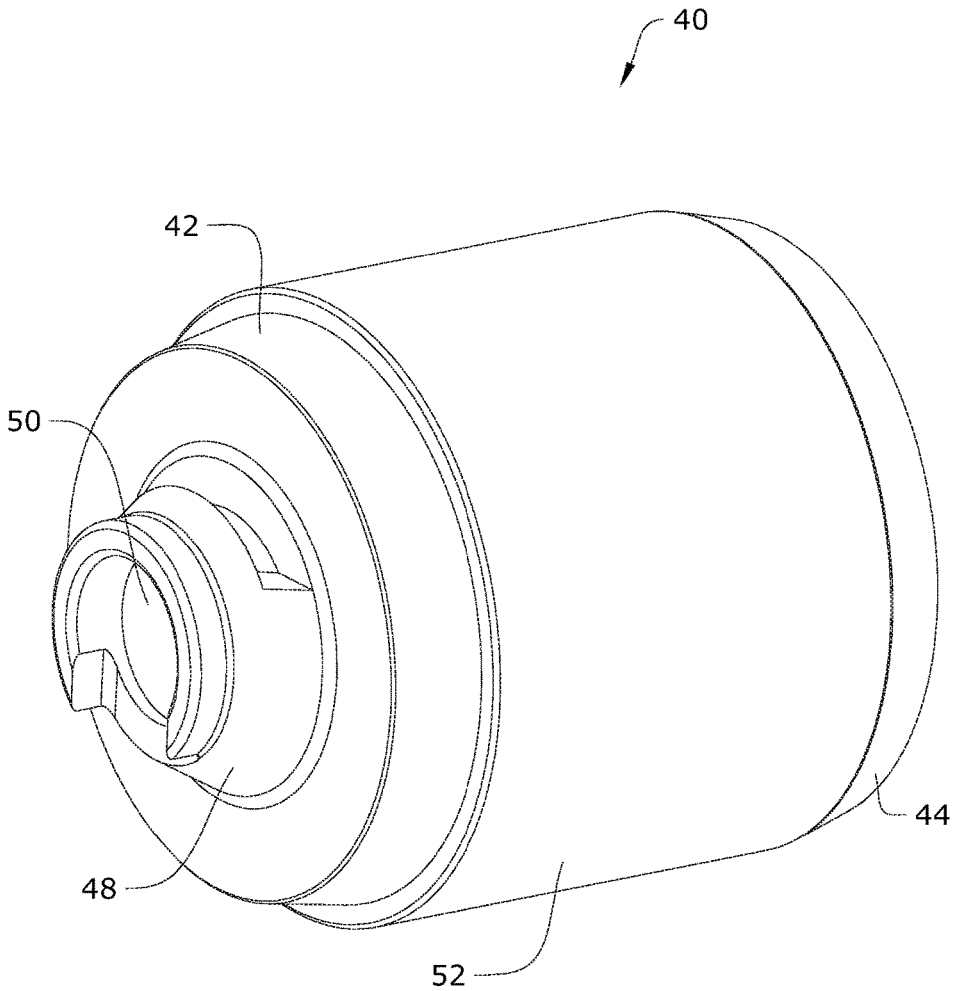
FIG. 9 is a perspective view of a rifle baffle of an embodiment of the present invention.

As illustrated in FIGS. 5 and 8, the firearm mount interface may be the rifle mount interface 32B or the magnum rifle mount interface 32C. Each of the rifle mount interface 32B and the magnum rifle mount interface 32C include a housing 66 having a proximal end 68 and a distal end 70. The distal end 70 includes a decreased diameter to fit within the first end 14 of the cylindrical body 12. The outer surface of the distal end 70 includes male threads 17 that mechanically secure to the female threads 15 of the inner surface of the cylindrical body 12. The proximal end 68 includes female threads 15 that mechanically secure to a rifle barrel or barrel adapter. The housing 66 of the magnum rifle mount interface 32C has a greater length than the housing 66 of the rifle mount interface 32B.

Each of the rifle mount interface 32B and the magnum rifle mount interface 32C may utilize a rifle baffle 40. The rifle baffle 40 may be the same shape as the other baffles 30 but also includes an elongated base. The elongated base includes a distal end 44 and a proximal end 42. Each of the distal end 44 and proximal end 42 may include tapers in opposing directions forming male frusto conical surfaces. The rifle baffle 40 fits within the proximal portion 24 of the cylindrical body 12. The male frusto conical surface of the distal end 44 of the rifle baffle 40 nests within and abuts against the female frusto-conical surface 28 of the proximal portion 24.

As mentioned above, the proximal end 42 of the rifle baffle 40 also includes the male frusto conical surface. The inner surface of the distal end 70 of each of the rifle mount interface 32B and the magnum rifle mount interface 32C includes a taper forming a female frusto-conical surface. The male frusto-conical surface of the proximal end 42 of the rifle baffle 40 nests within the female frusto-conical surface of the distal end 70 of the rifle mount interface 32B and the magnum rifle mount interface 32C. The opposing tapers of the rifle baffle 40 dampen vibration that would otherwise loosen the threaded connections. The opposing tapers also increase disc friction to prevent rotation of the parts.

It should be understood, of course, that the foregoing relates to exemplary embodiments of the invention and that modifications may be made without departing from the spirit and scope of the invention as set forth in the following claims.

What is claimed is:

1. A firearm suppressor comprising:

a cylindrical body having a first end, a second end comprising female threads, and an inner surface forming an internal bore, wherein the internal bore comprises a proximal portion and a distal portion;

a plurality of baffles disposed within the distal portion of the cylindrical body;

a lock collar comprising male threads releasably retained to the female threads formed within the second end, wherein an outer surface of the lock collar comprises a taper forming a female frusto-conical surface;

a discharge end cap comprising a discharge bore, a male frusto-conical surface, and male threads releasably retained to the female threads formed within the second end of the cylindrical body so that the lock collar is disposed in between the discharge end cap and one of the plurality of baffles, wherein the discharge end cap is tightened against the lock collar so that the male frusto-conical surface of the discharge end cap nests against the female frusto-conical surface of the lock collar; and a firearm mount interface comprising a receiving bore releasably securable to a firearm, wherein the firearm mount interface is releasably secured to the first end of the cylindrical body.

2. The firearm suppressor of claim 1, wherein the firearm mount interface is a pistol mount interface.

3. The firearm suppressor of claim 2, wherein the pistol mount interface comprises:

a housing comprising male threads releasably retained to female threads formed within the first end of the cylindrical body;

a piston disposed within the housing, wherein the piston is releasably securable to a pistol; and an end cap secured to the housing and retaining the piston within the housing.

4. The firearm suppressor of claim 1, wherein the inner surface of the proximal portion comprises a taper forming a female frusto-conical surface, and the firearm mount interface is a rifle mount interface.

5. The firearm suppressor of claim 4, further comprising a rifle baffle disposed within the proximal portion of the internal bore and comprising a distal end comprising an outer surface comprising a taper forming a male frusto-conical surface nesting against the female frusto-conical surface.

6. The firearm suppressor of claim 5, wherein the rifle baffle further comprises a proximal end comprising an outer surface comprising a taper forming a male frusto-conical surface, wherein the rifle mount interface comprises a distal end comprising an inner surface comprising a taper forming a female frusto-conical surface, wherein the male frusto-conical surface of the proximal end of the rifle baffle nests against the female frusto-conical surface of the distal end of the rifle mount interface.

7. The firearm suppressor of claim 1, wherein the plurality of baffles are detached from the cylindrical bore and are thereby removable from the distal portion, wherein a ledge is formed on the inner surface of the distal portion, wherein the base of one of the plurality of baffles rests against the ledge.

8. A firearm suppressor comprising:

a cylindrical body having a first end, a second end comprising a discharge bore, and an inner surface forming an internal bore, wherein the internal bore comprises a proximal portion and a distal portion, wherein the inner surface of the proximal portion comprises a taper forming a female frusto-conical surface;

a firearm mount interface comprising a receiving bore releasably securable to a firearm, wherein the firearm mount interface is releasably secured to the first end of the cylindrical body; and a rifle baffle disposed within the proximal portion of the internal bore and comprising a distal end comprising an outer surface comprising a taper forming a male frusto-conical surface nesting against the female frusto-conical surface.

9. The firearm suppressor of claim 8, wherein the rifle baffle further comprises a proximal end comprising an outer surface comprising a taper forming a male frusto-conical surface, wherein the rifle mount interface comprises a distal end comprising an inner surface comprising a taper forming a female frusto-conical surface, wherein the male frusto-conical surface of the proximal end of the rifle baffle nests against the female frusto-conical surface of the distal end of the rifle mount interface.

10. The firearm suppressor of claim 8, further comprising a plurality of baffles disposed within the distal portion of the cylindrical body.

11. The firearm suppressor of claim 10, further comprising a discharge end cap comprising the discharge bore and male threads releasably retained to female threads formed within the second end of the cylindrical body.

12. The firearm suppressor of claim 11, wherein the plurality of baffles are detached from the cylindrical bore and are thereby removable from the distal portion, wherein a ledge is formed on the inner surface of the distal portion, wherein the base of one of the plurality of baffles rests against the ledge.

13. The firearm suppressor of claim 11, further comprising a lock collar comprising male threads releasably retained to the female threads formed within the second end, wherein the lock collar is disposed in between the discharge end cap and one of the plurality of baffles.

14. The firearm suppressor of claim 13, wherein an inner surface of the discharge end cap comprises a taper forming a male frusto-conical surface and an outer surface of the lock collar comprises a taper forming a female frusto-conical surface, wherein the discharge end cap is tightened against the lock collar so that the male frusto-conical surface is within and abuts against the female frusto-conical surface.

* * * * *